US006939277B2

(12) United States Patent
Tuller et al.

(10) Patent No.: US 6,939,277 B2
(45) Date of Patent: Sep. 6, 2005

(54) ABDOMINAL EXERCISE MACHINE

(75) Inventors: Jeffrey Todd Tuller, Indian Wells, CA (US); Neal Patrick Barnes, Brooklyn Park, MN (US); Ross Austin Mackert, St. Louis Park, MN (US)

(73) Assignee: Guthy-Renker Corporation, Santa Monica, CA (US)

( * ) Notice: Subject to any disclaimer, the term of this patent is extended or adjusted under 35 U.S.C. 154(b) by 62 days.

(21) Appl. No.: 09/923,469

(22) Filed: Aug. 6, 2001

(65) Prior Publication Data

US 2002/0111256 A1 Aug. 15, 2002

Related U.S. Application Data

(60) Provisional application No. 60/268,446, filed on Feb. 12, 2001.

(51) Int. Cl.[7] ..... A63B 26/00; A63B 21/02; A63B 21/002

(52) U.S. Cl. ..... 482/140; 482/126; 482/91

(58) Field of Search ..... 482/140, 121–122, 482/123–126, 91, 12

(56) References Cited

U.S. PATENT DOCUMENTS

| | | | | | |
|---|---|---|---|---|---|
| 610,716 | A | * | 9/1898 | Marshall | 482/121 |
| 3,451,675 | A | * | 6/1969 | Burzenski | 482/126 |
| D242,936 | S | | 1/1977 | Docic | D34/5 K |
| 4,428,577 | A | * | 1/1984 | Weingardt | 482/126 |
| 4,603,858 | A | | 8/1986 | Reehil | 272/137 |
| D292,427 | S | | 10/1987 | Baburek | D21/198 |
| 4,861,022 | A | | 8/1989 | Boatcallie | 272/137 |
| 5,071,119 | A | | 12/1991 | Johnson | 272/130 |
| 5,176,622 | A | | 1/1993 | Anderson et al. | 602/19 |
| 5,224,914 | A | | 7/1993 | Friedman | 482/127 |
| 5,397,288 | A | * | 3/1995 | Sayre | 482/125 |
| 5,413,548 | A | | 5/1995 | Hoffman | 482/127 |
| 5,492,520 | A | | 2/1996 | Brown | 482/140 |
| 5,669,862 | A | | 9/1997 | Sayman | 482/127 |
| 5,695,436 | A | * | 12/1997 | Huang | 482/121 |
| D392,004 | S | | 3/1998 | Van Der Hoeven et al. | D21/191 |
| 5,759,138 | A | | 6/1998 | Boland | 482/122 |
| 5,851,167 | A | | 12/1998 | Li | 482/122 |
| 5,853,357 | A | | 12/1998 | Jones, Jr. | 482/140 |
| 5,891,005 | A | | 4/1999 | Drukarov | 482/140 |
| 5,957,820 | A | * | 9/1999 | Zarillo et al. | 482/121 |
| 5,964,685 | A | | 10/1999 | Boland | 482/122 |
| D420,070 | S | | 2/2000 | Zarillo et al. | D21/687 |
| 6,022,303 | A | * | 2/2000 | Abdo | 482/140 |
| 6,053,851 | A | | 4/2000 | Tu | 482/122 |
| 6,056,676 | A | | 5/2000 | Adams | 482/112 |
| 6,080,090 | A | | 6/2000 | Taylor et al. | 482/121 |
| 6,231,487 | B1 | * | 5/2001 | Diamond et al. | 482/121 |

* cited by examiner

*Primary Examiner*—Michael A. Brown
*Assistant Examiner*—Fenn C. Mathew
(74) *Attorney, Agent, or Firm*—Cislo & Thomas LLP

(57) ABSTRACT

An abdominal exercise device comprising a semi-rigid member, an upper member and a lower member is disclosed. The upper member and the lower member couple to the semi-rigid member, the upper member and lower member can be securely or detachably attachable to the semi-rigid member while the lower member can have pivoting capabilities. Feedback may be provided in a visual as well as a physical form to allow a user to determine whether the device is properly being used and optimal results are being achieved while performing the exercises.

9 Claims, 10 Drawing Sheets

ABDOMINAL EXERCISE MACHINE

CROSS-REFERENCES TO RELATED APPLICATIONS

This patent application is related to and claims priority from U.S. Provisional Patent Application Ser. No. 60/268,446 filed Feb. 12, 2001 by the named inventors herein entitled ABDOMINAL EXERCISE MACHINE, which provisional application is incorporated herein by this reference thereto.

BACKGROUND OF THE INVENTION

1. Field of the Invention

This invention relates generally to portable abdominal exercise machines and more specifically to abdominal exercise machines providing visible and physical feedback to users when proper abdominal crunch exercises are performed.

2. Description of the Related Art

Abdominal exercise machines, even portable abdominal exercise machines, are well known in the art. U.S. Pat. No. 5,964,685 issued Oct. 12, 1999 to Kevin O'Brien Boland discloses an abdominal and arms muscle exercise device designed to be used on the lap of the individual for conditioning the abdominal and arm muscles. The device is lap supported with a linear pair of sidewall members, an elongate cross-member with terminal upswept handles. A lower elongate cross bar is tucked into the user's lap and the upstanding pair of support members extends to a cross bar which rests against the upper torso of the individual using the device.

U.S. Pat. No. 5,851,167 issued Dec. 22, 1998 to Tianfu Li discloses an exerciser that is used to improve the muscles and may be used in various ways, including a sitting position. The device comprises an elastic ring that extends from an elastic flexible rod along with one spiral ring and two pairs of grips. The device may be used for muscular strengths of the arms by pushing and pulling the grip pairs.

U.S. Pat. No. 6,056,676 issued May 2, 2000 to Cleveophis Adams discloses an exercise device and a method of its use. The device is designed to facilitate the strengthening of abdominal and back muscles and includes a resistance member that is coupled between a lap engageable base and an arm positioning member. The device includes a lap engaging frame with an annular rim member that is adapted to rest on the lap of the user. The tubular central support or cross member extends between and is affixed to opposite sides of the rim member to support a pair of curved thigh brace members. The thigh brace members are adapted to engage and bear forcibly against the inner thighs of user. Resistance member is provided between the lap engaging frame and the hand brace members.

U.S. Pat. No. 5,891,005 issued Apr. 6, 1999 to Henry Drukarov discloses a head and neck support for abdominal exercise. The abdominal exercise device comprises a base member with a cylindrical member secured to the forward edge thereof An upper member is hingedly coupled to the forward edge of base member and receives a handle portion which is adjustably received within the open rearward edge. The handle portion includes a cross-bar.

SUMMARY OF THE INVENTION

The present invention provides a portable abdominal exercise machine for use in a seated position, on any standard chair or couch, while lying flat on the floor, or a variety of other positions. Feedback may be provided in a visual as well as a physical form to allow a user to determine whether the device is properly being used and optimal results are being achieved while performing the exercises. In a preferred embodiment, the present invention comprises a semi-rigid member, an upper member and a lower member, with the semi-rigid member coupling to the upper and lower members. The upper and lower members comprise generally extending members and the semi-rigid member provides a range of bending force; whereby physical and visual feedback is provided when a proper crunch is performed.

The generally extending members of the upper member separates by a range from 0–180 degrees with the upper member further comprising an engagement member. A pivoting joint couples the semi-rigid member to the lower member. Just as the semi-rigid member is securely coupled to the upper member, it is also securely coupled to the pivoting joint. In other embodiments, the semi-rigid member is detachably attachable to the upper member and the pivoting joint.

The semi-rigid member is coupled to the upper member by upper attachment means and coupled to the lower member by lower attachment means. The generally extending members of the upper member may be curved and the generally extending members of the lower member may comprise padded rollers. Also, the semi-rigid member may securely couple to the upper and lower attachment means, but may be detachably attachable.

In other embodiments, the generally extending members of the upper member comprise handgrips and these handgrips have the ability to rotate. In yet other embodiments, the upper attachment means comprises a flex joint. Also, the lower attachment means may comprise a pivot joint providing either a pivot motion along the axis of the semi-rigid member or a combination of a pivot motion along the axis of the semi-rigid member and a rotational pivoting motion. The semi-rigid member can be coupled to the pivot joint by a flex joint and a plurality of bolts.

The lower attachment means can also comprise a ball joint. The ball joint may comprise a ball joint assembly having an opening and a ball joint cover. The semi-rigid member couples to the opening of the ball joint assembly and the ball joint allows for a side to side as well as a front to back motion of the semi-rigid member. The generally extending members may be substantially parallel to the lower member.

In yet another embodiment, the abdominal exercise machine comprises a plurality of semi-rigid members, an upper member and a lower member. The plurality of semi-rigid members are coupled to the upper and lower members. These upper said lower members comprising generally extending members, which are curved. The plurality of semi-rigid members provide a range of bending force whereby physical and visual feedback is provided when a proper crunch is performed. The plurality of semi-rigid members either securely or detachably attachable to the upper and lower attachment means.

In yet another embodiment of the present invention the abdominal exercise machine comprises, a hinged-rigid member, a top member, a lower member and an elastic member. The top and the lower member comprise generally extending members and the hinged-rigid member couples to the lower and top member, while the elastic member is coupled to the hinged-rigid member; whereby physical and visual feedback is provided when a proper crunch is performed. The top member has length adjustment means and the elastic member may be detachably attachable to the hinged-rigid member.

OBJECTS OF THE INVENTION

It is an object of the present invention to provide a portable abdominal exercise device which aides the user in performing a proper abdominal crunch and provides resistance during the abdominal crunch.

It is a further object of the present invention to provide feedback in a visual as well as physical form to allow a user to determine whether the device is properly being used and optimal results are being achieved.

It is a further object of the present invention to allow resistance while in a seated position, while lying flat on the floor or various other positions.

It is a further object of the present invention to allow the user to perform exercises used to isolate the upper and mid abdominals, obliques and lower abdominal muscles It is a further object of the present invention to provide ease of manufacturing.

It is a further object of the present invention to have few moving parts to assemble.

It is a further object of the present invention to provide transportability.

These and other objects and advantages of the present invention will be apparent from a review of the following specification and accompanying drawings.

BRIEF DESCRIPTION OF THE DRAWINGS

FIG. 6*a* is a front view of an embodiment of the lower attachment means of the present invention, as shown in FIG. 6.

DESCRIPTION OF THE PREFERRED EMBODIMENT(S)

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Figure 1:
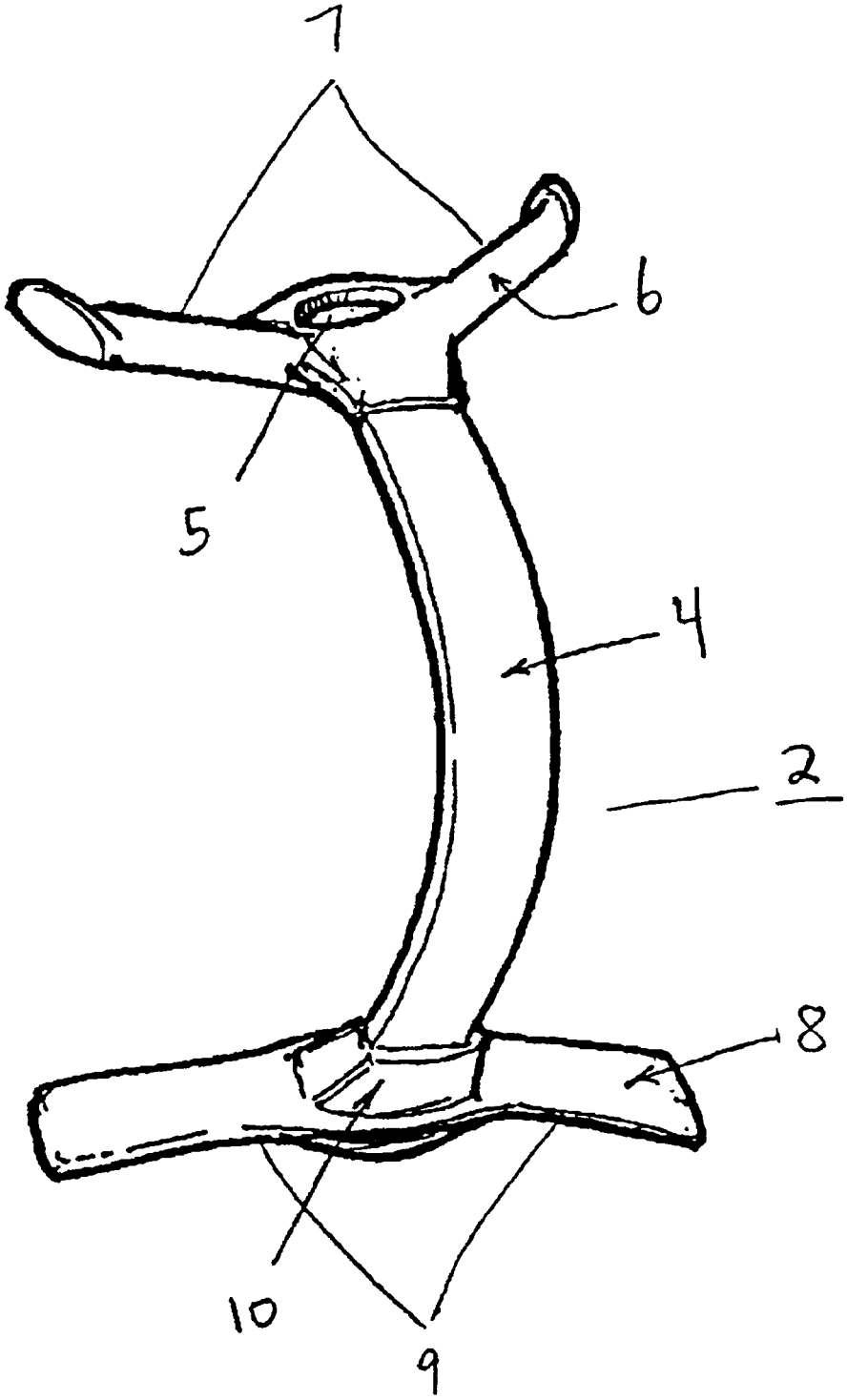
FIG. 1 is a perspective view of one preferred embodiment of the present invention.
Figure 2:
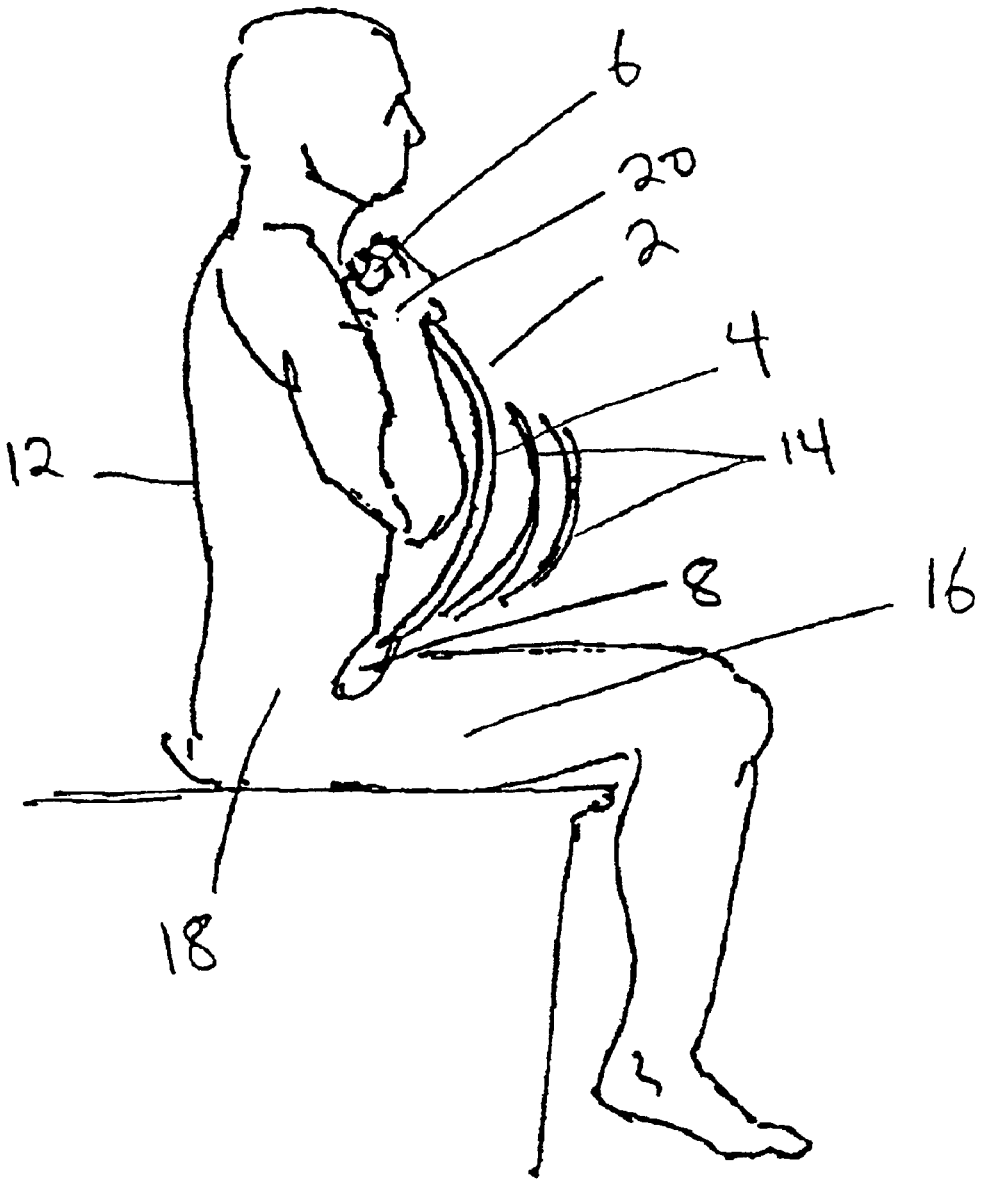
FIG. 2 is a side view demonstrating the use of the present invention.

FIGS. 1 and 2 represent one preferred embodiment of the present invention and one preferred usage of the present invention. The portable abdominal exercise device 2 comprises a semi-rigid member 4, an upper member 6, or handle bar and a lower member 8, or lap pad. The upper member 6 is coupled to the semi-rigid member 4 and the lower member 8 is coupled to the semi-rigid member 4 with a pivoting joint 10. The semi-rigid member 4 is slip-fitted into both the upper member 6 and lower member 8. While set screws or spring loaded pop pins may be used to secure the semi-rigid member 4, none is required because the force involved in the use of the present invention enables the semi-rigid member 4 to remain coupled with the upper member 6 and the lower member 8. The upper member 6 comprises an engagement member 5, which can be used for carrying or storing of the abdominal exercise device 2. Also, the upper member 6 comprises two generally extending members 7, which preferably range from 0–180 degrees apart. The two generally extending members 7 may be parallel to one another (0 degrees apart), in the same plane (180 degrees apart) or any position in between. The upper member 6, lower member 8 and pivoting joint 10, may comprise plastics, steel, nylon, rubber or other materials with similar properties.

The lower member 8 comprises two generally extending members 9, both flare to engage the legs of the user. The lower member 8 may also comprise many different styles and shapes of extensions that comprise engagement members. These engagement members may be used for transporting or storing the present invention. In this preferred embodiment, the semi-rigid member 4 is approximately 18 inches long and will provide a range of bending force, preferably 10–80 pounds, and is securely attached to the upper member 6 and pivotally attached to the lower member 8. The semi-rigid member 4 may comprise any semi-rigid resilient material, such as but not limited to fiberglass, plastics, composite plastic or resins, high density rubbers, spring steel or coil spring, that provides a rigid starting point, produces force upon bending and returns to its original shape and position upon release of the force, without permanent deformation. The semi-rigid member 4 can be straight or, in one preferred embodiment, slightly bent, with the bend facing outward from the user 12. The mechanics of the semi-rigid member 4 and pivoting joint 10 provide visual and physical feedback to a user when a proper crunch is performed, one that uses the abdominal muscles versus an improper crunch involving hip-flexors and/or back muscles. In this embodiment, the semi-rigid member 4.

The present invention can be designed either with the semi-rigid member 4 permanently attached to the lower member 8 and upper member 6 or can be detachably attached allowing for interchangeability of semi-rigid members 4 to allow for different resistance levels and different styles of upper members 6 and lower members 8. By interchanging a weaker semi-rigid member 4 with a stronger semi-rigid member 4, the resistance offered by the device will be stronger, therefore causing increased exertion of a user's muscles.

FIG. 2 shows a user 12 in a seated position holding the abdominal exercise device 2. When the user 12 properly positions the abdominal exercise device 2, the generally extending members (not shown) of the lower member 8 rests on the upper leg region 16, proximal to the waist 18 and the user 12 grasps the generally extending members (not shown)

of the upper member 6 with his/her hands 20. When a user 12 merely bends forward (hip-flexor motion), the semi-rigid member 4 swings forward with the pivoting joint 10 and does not flex. When a proper crunch is performed, the semi-rigid member 4 bends providing visual feedback 14. This bending 14 produces force on the user's abdominal muscles offering physical feedback. Therefore, most users will experience resistance forces when they perform a proper crunch and not when performing an improper hip-flexor crunch.

Figure 3:
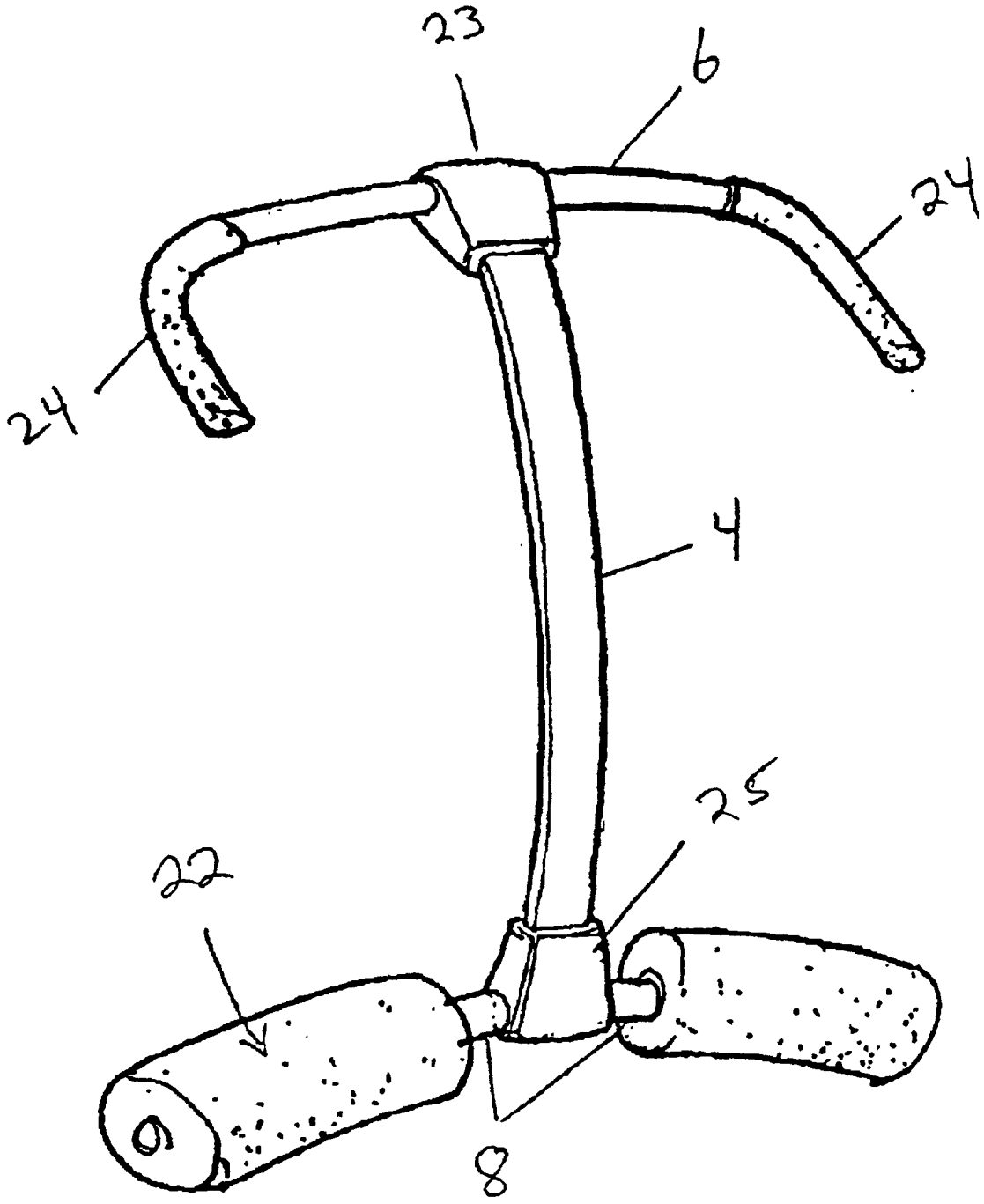
FIG. 3 is a perspective view of another embodiment of the present invention.

The lower member 8 can comprise any rigid material that provides reasonable comfort to the user 12 in dissipating the bending force across the upper leg region 16. The preferred material is molded plastic or any other material that can flex, but the lower member 8 can comprise other similar materials. The lower member 8 can be molded to generally match the curvature of the upper leg region 16, can be flat or, as shown in FIG. 3, can be padded rollers 22 with the preferred shape being round. These padded rollers 22 can rest on the user's legs or be strapped to them.

The upper member 6 can comprise any rigid material and can be shaped in a plurality of ways. As shown in FIG. 1, the upper member 6 provides for a user (not shown) the ability to grip the upper member 6 or rest the upper member 6 against the upper chest, or both simultaneously, such that a downward force can be applied to the semi-rigid member 4. Also, as shown in FIG. 3, the upper member 6 may comprise curved extending members 24 allowing a different grip to be applied on the upper member 6. These curved extending members 24 preferably face outward from the user, parallel to one another, but could be at any angle to one another. The curved extending members 24 couple to the semi-rigid member 4 with upper attachment means 23 and the lower member 8, covered by padded rollers 22, couple to the semi-rigid member 4 with lower attachment means 25. The upper attachment means 23 is part of the upper member 6 and the lower attachment means 25 is part of the lower member 8.

Figure 4:
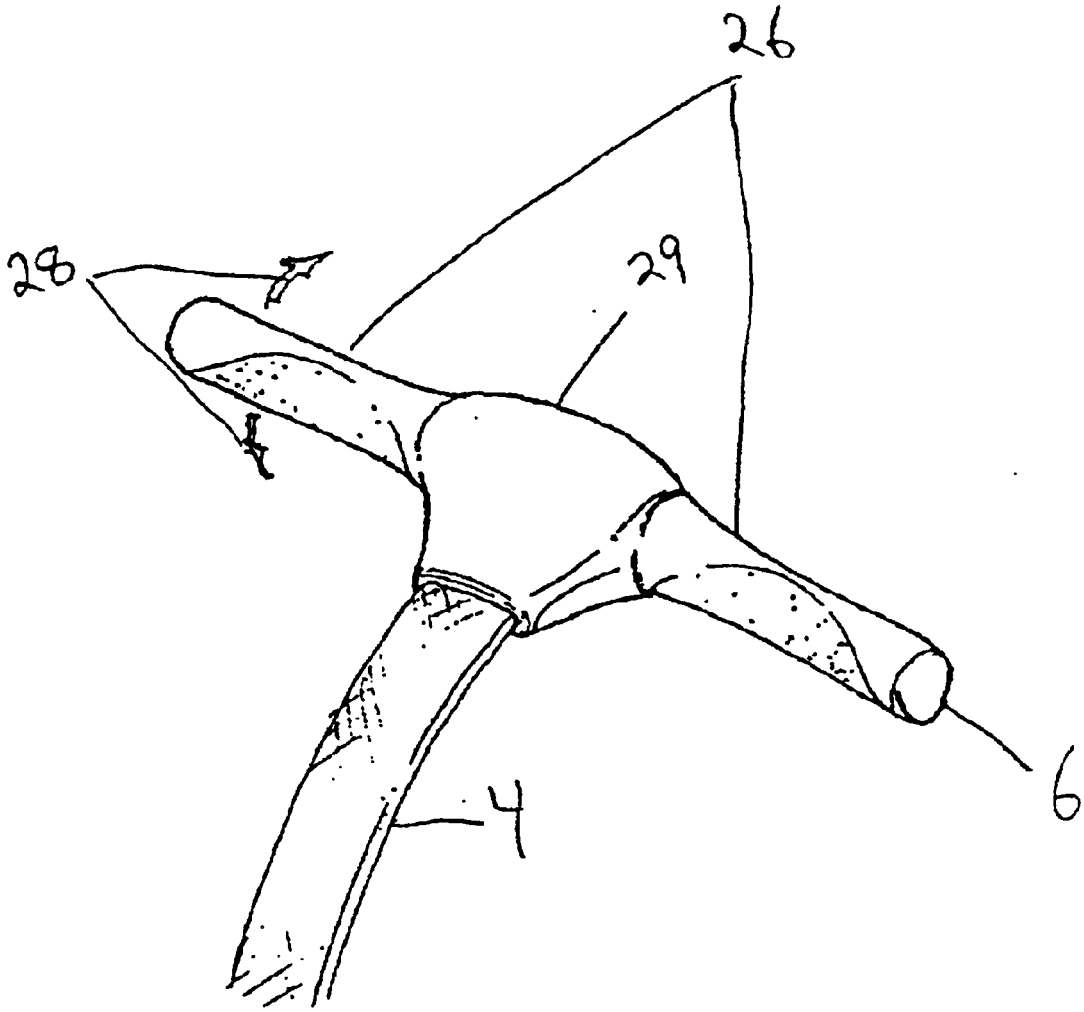
FIG. 4 is a perspective view of another embodiment of the upper member of the present invention.
Figure 5:
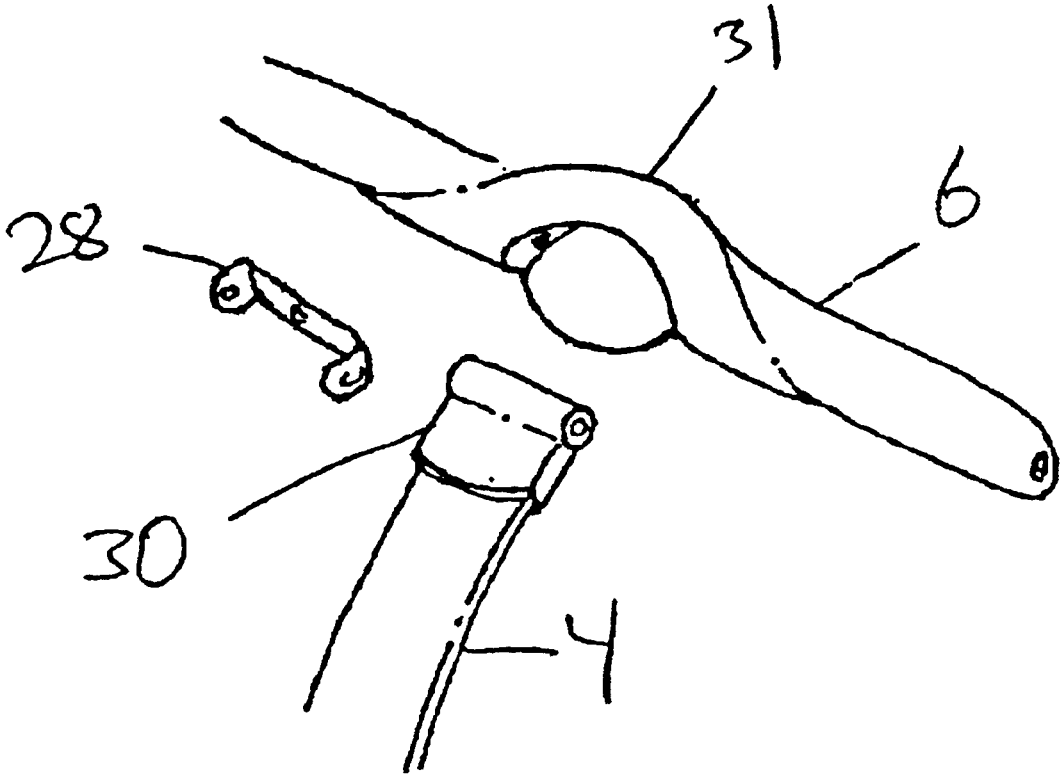
FIG. 5 is an exploded view of yet another embodiment of the upper member of the present invention.

As shown in FIG. 4, the upper member 6 may contain handgrips 26 that have the ability to rotate 28, such that they adjust to the bending moment of the semi-rigid member 4. These handgrips 26 are coupled to the semi-rigid member 4 with attachment means 29. Also, FIG. 5 shows another embodiment of the upper member 6 used to compensate for the bending moment of the semi-rigid member 4. In this embodiment, the upper member 6 is coupled to the semi-rigid member 4 by a flex joint 28 coupled to attachment means 30. In this embodiment, the midpoint 31 of the upper member 6 has an arched area and slopes downward from the midpoint 31, then straightens towards the end.

Figure 6:
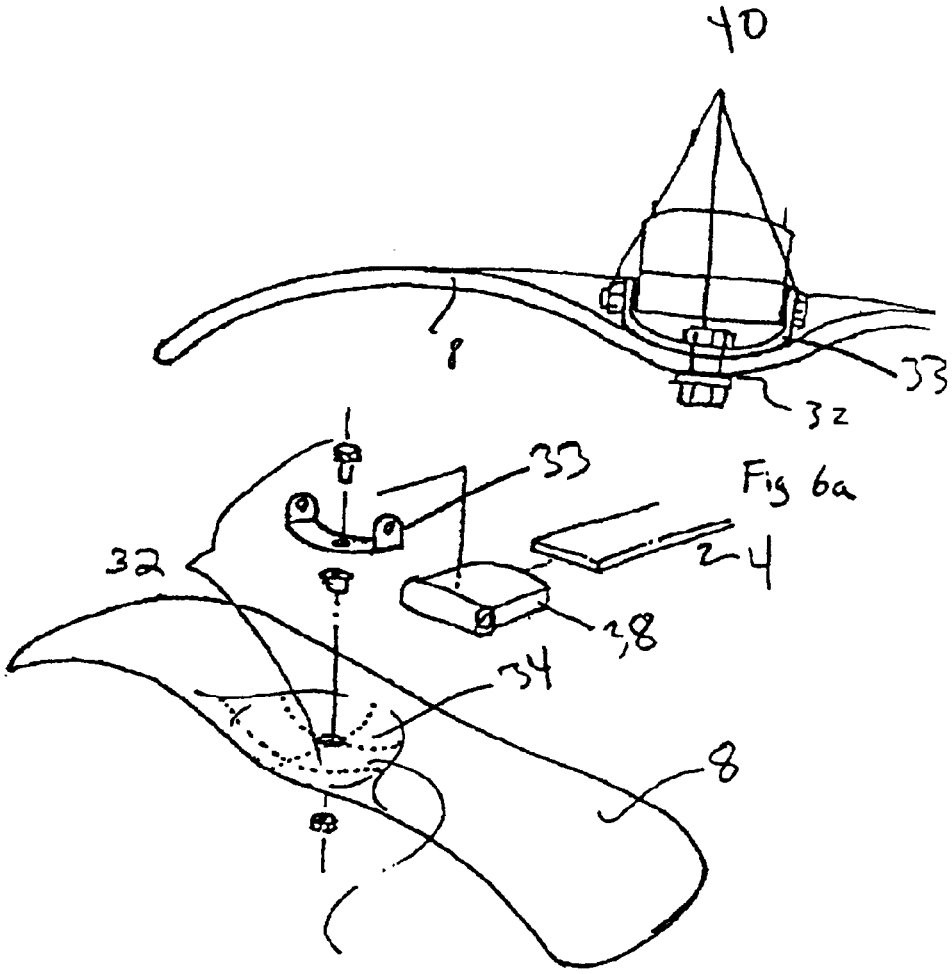
FIG. 6 is an exploded view of an embodiment of the lower attachment means of the present invention.

In FIG. 6, one embodiment of the connection between the semi-rigid member 4 and the lower member 8 is shown. The pivot joint 32 between the lower member 8 and the semi-rigid member 4 can be designed to provide either, only a pivot motion along the axis of the semi-rigid member 4 or a combination of a pivot motion along the axis of the semi-rigid member 4 with a rotational pivoting motion, which accommodates the exercises for the oblique muscles. The pivot joint 32 couples the lower member 8 to attachment means 38, which couples to the semi-rigid member 4. As shown in FIGS. 6 and 6*a*, a plurality of bolts 40 coupled to a flex joint 33 allow the coupling of the attachment means 38 and the lower member 8 to create the pivot joint 32. This pivot joint 32 can take the form of a swivel joint as shown, a rocker pivot joint, a ball joint or a combination of those joints. In this embodiment, the lower member 8 has a concave cavity 34 allowing the pivot joint 32 the ability to swivel. Other connection methods may be used which allow similar motion of the semi-rigid member 4.

Figure 7:
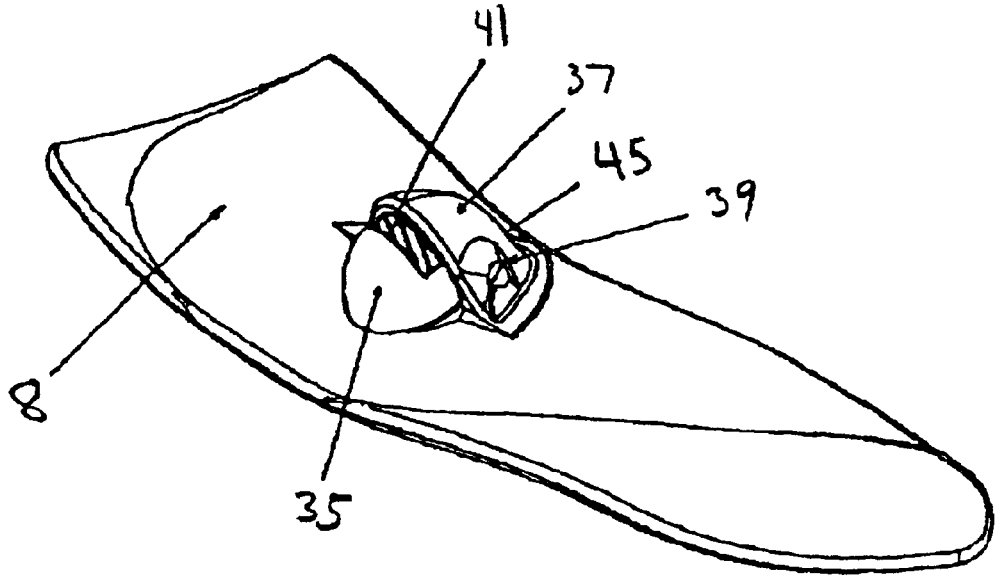
FIG. 7 is a perspective view of another embodiment of the lower member of the present invention.
Figure 8:
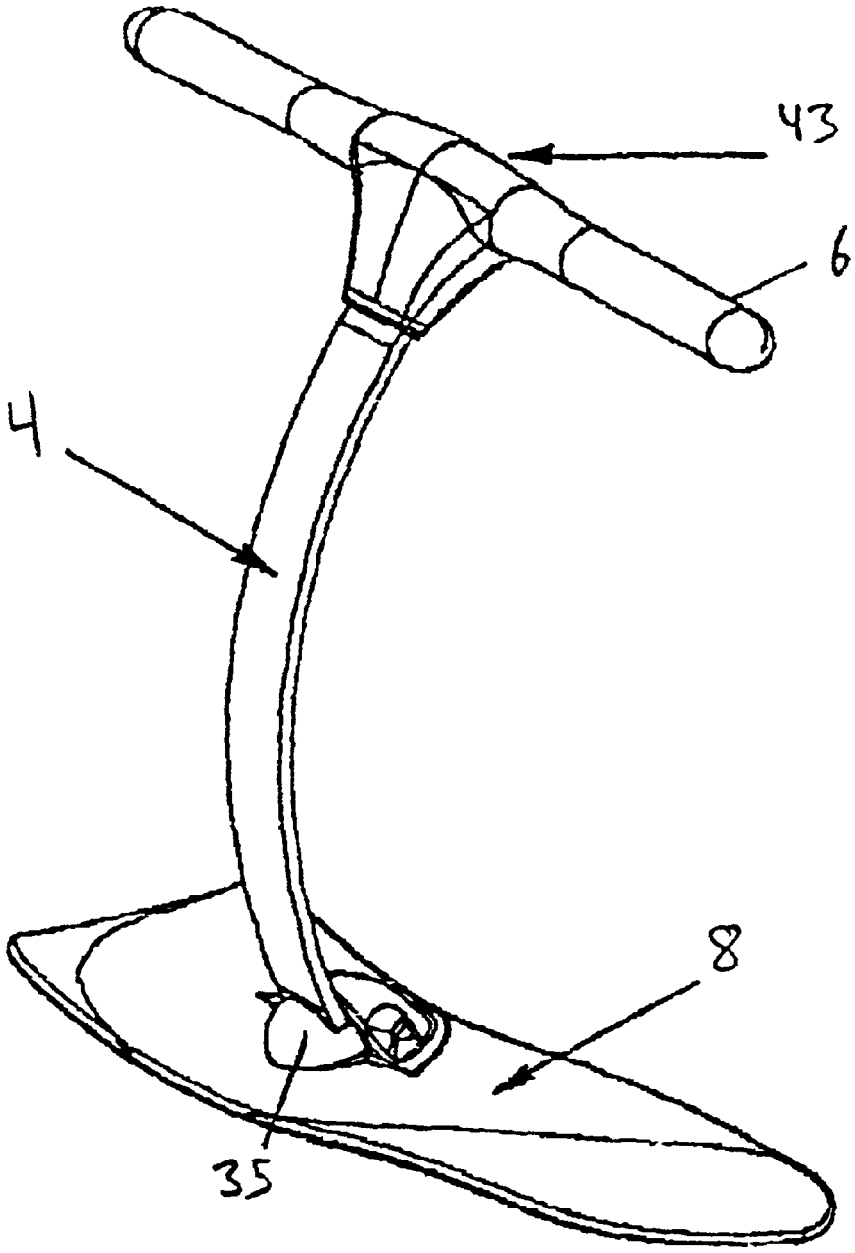
FIG. 8 is a perspective view of the present invention having the lower member as shown in FIG. 7.

Another embodiment of the pivoting joint, a ball joint 45, of the present invention is shown in FIG. 7. Here, a ball joint assembly 35 having a ball joint cover 37 and a shroud 39 can be coupled to a lower member 8. The ball joint assembly 35 may contain an opening 41 where the semi-rigid member 4, as shown in FIG. 8, attaches. The upper member 6 couples to the semi-rigid member 4 with attachment means 43. The pivoting joint 45 of this embodiment can allow for a side to side as well as a front to back motion of the semi-rigid member 4, which allows a complete range of exercises capable of working the oblique muscles and the upper, mid, and lower abdominal muscles.

Figure 9:
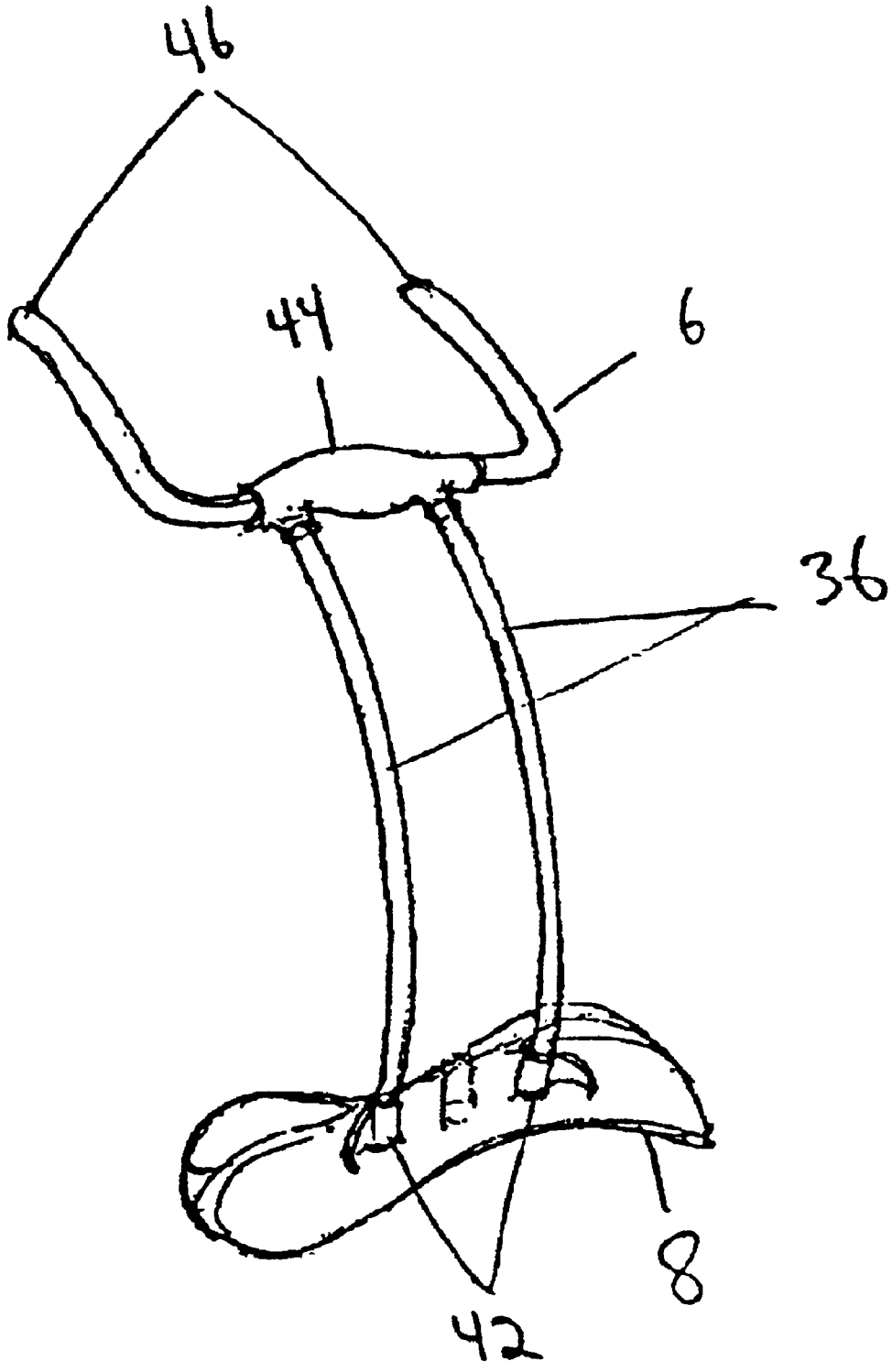
FIG. 9 is a perspective view of another embodiment of the present invention.

Another embodiment of the present invention is shown in FIG. 9. Here, a plurality of semi-rigid members 36 are used. In this embodiment, two semi-rigid members 36 can be aligned along side one another and can be coupled to a lower member 8 by attachment means 42 and to an upper member 6 by attachment means 44. The upper member comprises two generally extending members 46, which preferably extend parallel to one another, but can be used in other orientations. In other embodiments, the semi-rigid members 36 may align in front of one another as well as comprise more than two semi-rigid members 36.

Figure 10:
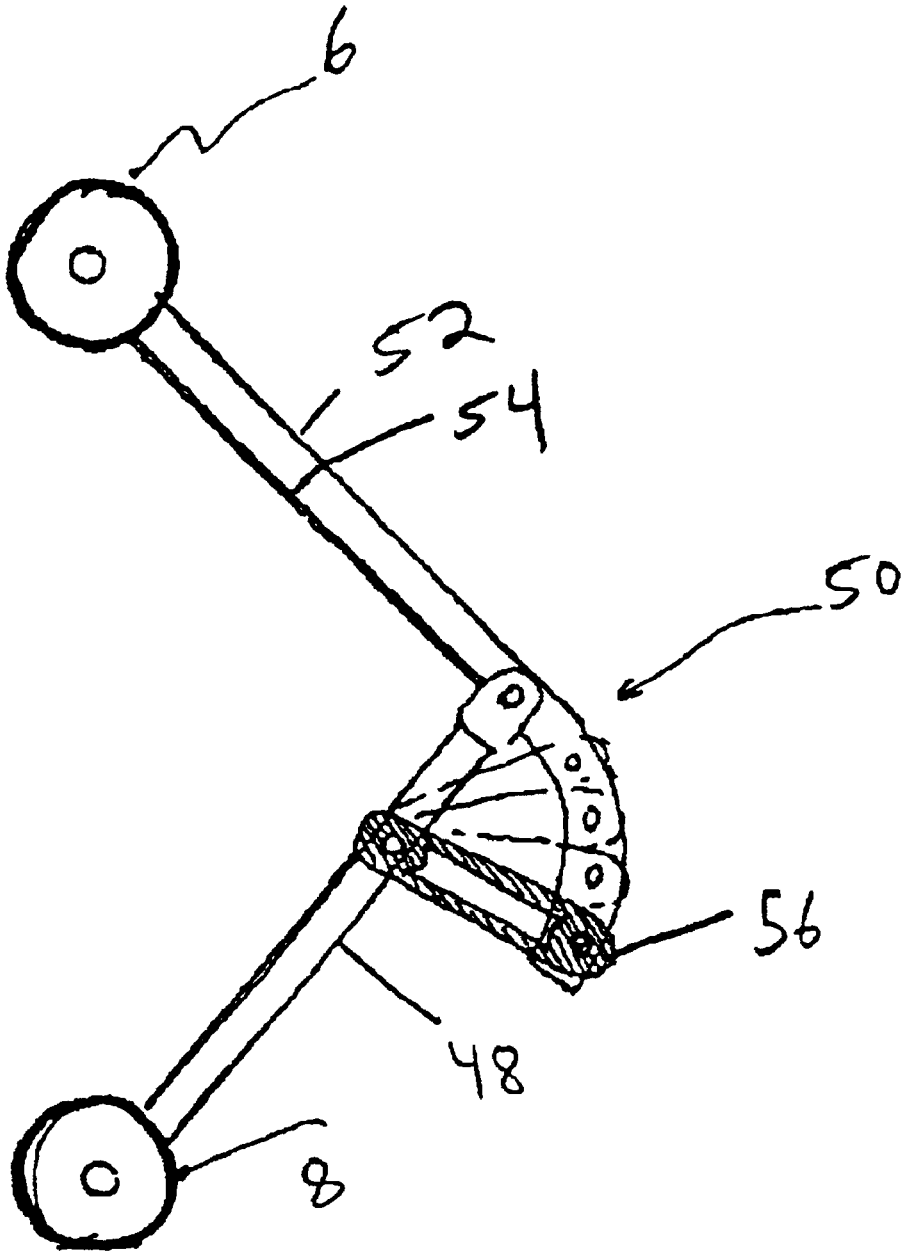
FIG. 10 is a perspective view of yet another embodiment of the present invention.

FIG. 10 shows yet another embodiment of the present invention. In this embodiment, there exists an elastic member 56 coupled to a hinged-rigid member 48 that couples to a lower member 8 and a top member 52. Similar to the semi-rigid member in the prior embodiments, the hinged-rigid member 48 will only provide visual feedback 50 and physical feedback when a proper crunch is performed. In this embodiment, a proper crunch movement causes the hinged-rigid member 48 to move forward and in conjunction with the elastic member 56 provide physical resistance, while an improper crunch movement may cause no movement of the hinged-rigid member 48 and may not provide physical resistance. The elastic member 56 can be a rubber band, but any material with similar properties that can provide resistance can be used. The elastic member 56 can also be detachably attachable to the hinged-rigid member 48 allowing for the interchanging of elastic members 56 that provide different resistance levels. This embodiment has an adjustment capability 54, which allows the length of the top member 52 to be adjusted, either shortening or lengthening the top member 52.

While the present invention has been described with regards to particular embodiments, it is recognized that additional variations of the present invention may be devised without departing from the inventive concept.

What is claimed is:

1. An abdominal exercise machine for exercising abdominal muscles, comprising:

at least one upper grasping portion positionable in front of a user and configured so as to be held by at least one of a user's hands and further so shaped and configured in size to be engaged by a user's chest;

a flat elongated flexible member flexible along some portion of its length and positionable in front of a user and connected to said upper grasping portion at a first end;

an upper thigh engagement member of a shape, size and configuration so as to comfortably rest on a user's upper thighs in a standing, sitting or lying position and pivotally coupled to a second end of the elongated flexible member;

wherein the user can position the machine in front during use and be held between a user's upper thigh portions and chest area so as to provide resistance during a stomach crunch motion and yet still provide visual cuing during use so as to view the degree of flexing of the elongated flexible member during use.

2. The abdominal exercise machine of claim 1 wherein the upper thigh enhancement member is attached to the second end of the elongated flexible member by a pivoting joint.

3. The abdominal exercise machine of claim 2, wherein the pivot joint providing a combination of a pivot motion along the axis of said semi-rigid member and a rotational pivoting motion.

4. The abdominal exercise machine of claim 1, further comprising:

a coupling means comprising a ball joint having a ball joint assembly, a ball joint cover, and an opening;

said elongate flexible member coupled to said ball joint via said opening of said ball joint assembly; and said ball joint allowing for a side to side as well as a front to back motion of said elongate flexible member.

5. The abdominal exercise machine of claim 4, wherein said at least one upper grasping portion are substantially parallel to said upper thigh engagement member.

6. The abdominal exercise machine of claim 1 further comprising two upper grasping members, wherein the upper grasping members are spaced apart approximately 0° to approximately 180°.

7. The abdominal exercise machine of claim 1 wherein the upper thigh engagement member further comprises:

an opening sized to receive the second end of the elongated flexible member.

8. The abdominal exercise machine of claim 1 wherein the at least one upper grasping member are rotatable handgrips.

9. An abdominal exercise machine for exercising abdominal muscles, comprising:

means for grasping an upper portion of the abdominal exercise machine wherein said grasping means have terminal ends extending in generally opposite directions;

means for engaging a top of an user's thighs wherein said thigh engaging means have ends extending in generally opposite directions; and semi-rigid means for flexibly resisting compression, said semi-rigid means coupling said grasping means and said thigh engaging means, said semi-rigid means spanning abdominal muscles for exercise thereof wherein said semi-rigid means are pivotally coupled to said thigh engaging means;

whereby abdominal muscles are exercised when said semi-rigid means undergoes compression when said is brought towards said lower body portion and feedback is provide during a predetermined abdominal exercise.

* * * * *